US006641710B2

(12) United States Patent
Sakura et al.

(10) Patent No.: US 6,641,710 B2
(45) Date of Patent: Nov. 4, 2003

(54) METAL PLATING METHOD

(75) Inventors: Yasuo Sakura, Hamamatsu (JP); Itoyo Tsuchiya, Tagata-gun (JP); Keiko Mano, Numazu (JP)

(73) Assignee: Soqi, Inc., Shizuoka (JP)

( * ) Notice: Subject to any disclaimer, the term of this patent is extended or adjusted under 35 U.S.C. 154(b) by 74 days.

(21) Appl. No.: 09/940,823

(22) Filed: Aug. 27, 2001

(65) Prior Publication Data

US 2002/0056644 A1 May 16, 2002

(30) Foreign Application Priority Data

Aug. 29, 2000 (JP) ..... 2000-258325
Aug. 9, 2001 (JP) ..... 2001-242227

(51) Int. Cl.[7] ..... C25D 5/18

(52) U.S. Cl. ..... 205/102; 205/103; 205/104; 205/133

(58) Field of Search ..... 205/102, 103, 205/104, 133

(56) References Cited

U.S. PATENT DOCUMENTS 4,869,971 A * 9/1989 Nee et al. ..... 428/635
4,875,983 A * 10/1989 Alota et al. ..... 205/104

FOREIGN PATENT DOCUMENTS

| | | | |
|---|---|---|---|
| GB | 2236763 A | | 4/1991 |
| JP | 3-207884 A | | 9/1991 |
| JP | 05339749 A | | 12/1993 |
| JP | 07316874 A | | 12/1995 |
| JP | 08127892 | | 5/1996 |
| JP | 09095793 | | 4/1997 |
| JP | 09184097 | | 7/1997 |
| JP | 11071696 A | | 3/1999 |
| JP | 11-507991 A | | 7/1999 |
| WO | WO 97/00980 | | 1/1997 |

* cited by examiner

*Primary Examiner*—Roy King
*Assistant Examiner*—Wesley A. Nicolas
(74) *Attorney, Agent, or Firm*—Dickstein, Shapiro, Morin & Oshinsky, LLP.

(57) ABSTRACT

To provide a method of metal plating to give a metal plating coating with excellent luster and high corrosion resistance and wear resistance. This metal plating method includes pulse plating by pulsed electrolysis by periodically applying electric current. The pulsed electrolysis is carried out in condition that the pulse frequency and the current density are controlled so that the ratio of the quantity of deposited lattice per pulse to the height of the lattice is 0.28 or lower, that the duty ratio of the pulse frequency is controlled to be 0.5 or lower, and that the duration of complete pause caused by distortion of pulse waveform is controlled to be one half or longer of the duration of current interruption. The foregoing plating is carried out while fluidizing plating solution to be brought into contact with the object body 5 at a flow rate of 0.04 (m/s) or higher and making the solution evenly flow along the face to be plated.

7 Claims, 10 Drawing Sheets

FIG. 2 (a)
FIG. 2 (b)
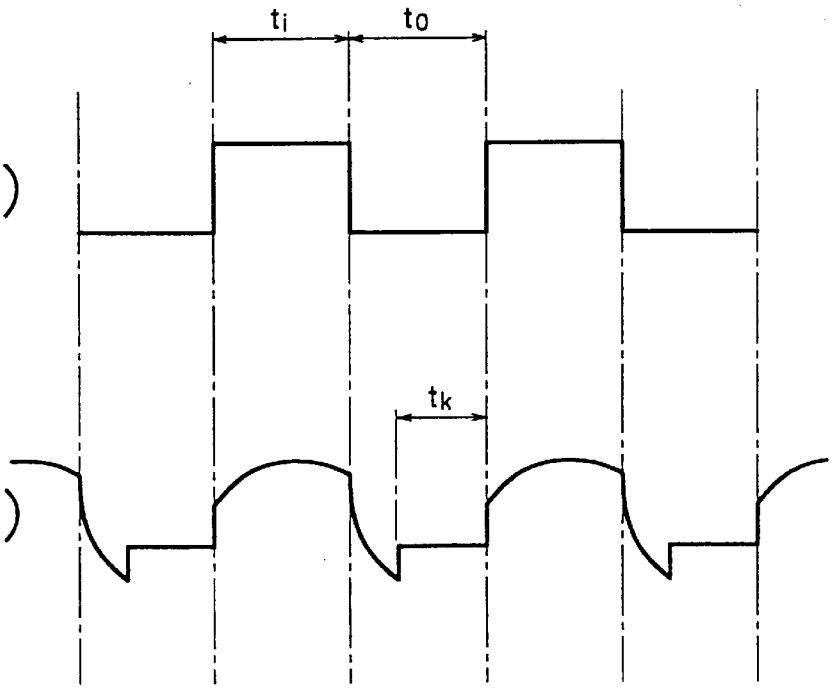
FIG. 3
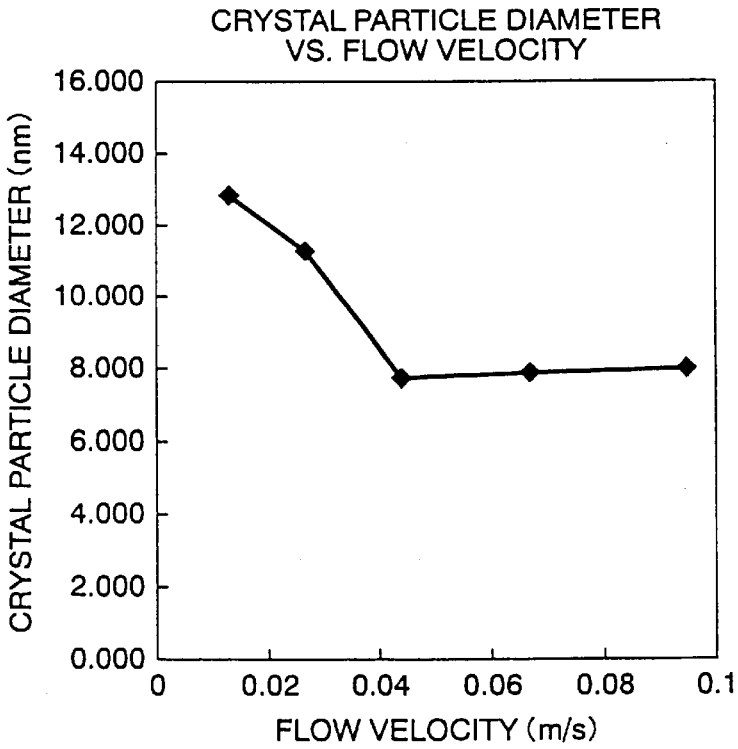

| FLOW VELOCITY | (111)ORIENTATION RATIO |
|---|---|
| 0.013m/s | 86.9% |
| 0.027m/s | 70.4% |
| 0.044m/s | 96.1% |
| 0.067m/s | 97.0% |
| 0.095m/s | 97.0% |

| FLOW VELOCITY | (111)ORIENTATION RATIO |
|---|---|
| 1630Hz | 99.0% |
| 1000Hz | 99.8% |
| 900Hz | 99.0% |
| 800Hz | 98.0% |
| 700Hz | 98.0% |

METAL PLATING METHOD

BACKGROUND OF THE INVENTION

1. Field of the Invention

The present invention relates to a metal plating method for depositing a metal such as chromium on the surface of an object body to be plated which is immersed in a plating solution by electroplating by pulsed electrolysis.

2. Description of the Prior Art

Chromium plating has conventionally been carried out to obtain a highly corrosion resistible hard coating. In this case, since cracking is likely to occur on the surface of the object body to be plated if chromium is plated directly on the surface, nickel plating is carried out on the surface of the object body to make the surface of the foregoing object body smooth and then chromium plating is carried out. That is, in general, the highly corrosion resistant hard chromium coating has a double layer structure of nickel and chromium.

The foregoing chromium deposition is carried out by depositing a chromium layer on the surface of an object body to be plated by applying direct current while immersing the object body in a plating solution in a plating tank. Electrolysis is generally carried out by continuously applying direct current of 10 to 60 A/dm$^2$. The temperature of the plating solution bath is about 40 to 60° C.

SUMMARY OF THE INVENTION

With the foregoing electroplating method, the coating thickness of the resulting chromium layer cannot be about 10 $\mu$m or thinner and when attempting to make the coating thicker, cracking may occur resulting poor corrosion resistance.

Further, there also occurs a problem that the luster of the plated film is inferior.

The foregoing cracking occurrence is attributed to stress generated by hydrogen evolved simultaneously with chromium electrode position. In other words, at the time of reductive precipitation, about 8 to 10 hydrogen atoms are evolved per chromium atom and with the foregoing conventional method, metal ion falls like a shower on the surface of the object to be plated, so the time between the reduction and the lattice assembly cannot be sufficiently long. In this reason, while the chromium layer to be deposited is grown as a crystal lattice with low atomic density, hydrogen is incorporated in the chromium layer. Consequently, the thicker the coating thickness is made, more likely cracking is to occur.

The present invention is, therefore, performed in consideration of the above described problems and provides a metal plating method for obtaining a metal plated film with good luster and excellent corrosion resistance and wear resistance.

According to one aspect of the present invention, a metal plating method can be provided for carrying out pulse plating by pulsed electrolysis by periodically applying electricity, wherein the above described pulsed electrolysis is carried out in condition that the pulse frequency and the current density are controlled so that the ratio of the quantity of deposited lattice per pulse to the height of the lattice is about 0.28 or lower, that the duty ratio of the above described pulse frequency is controlled to be 0.5 or lower, and that the duration of complete pause caused by distortion of pulse waveform is controlled to be one half or longer of the duration of current interruption.

"the ratio of the quantity of deposited lattice per pulse to the height of the lattice" is dimensionless number. Further, "the height of the lattice" indicates the height of lattice when the crystal face is oriented in the (111) face where the atomic density is highest.

"the ratio of the quantity of deposited lattice per pulse to the height of the lattice" is defined as "(the quantity of deposited lattice per pulse)/the height of the lattice" and "the ratio of the quantity of deposited lattice per pulse to the height of the lattice" is sometimes only described to be the ratio of the quantity of deposited lattice.

The above described duty ratio means $t_i/(t_i+t_0)$ (refer to FIG. 2), wherein $t_i$ denotes a duration of pulsed current application and $t_0$ denotes a duration of current interruption.

If the pulse waveform is an ideal one, the duration of current interruption $t_0$ is equal to the time during which no current flows between the electrodes, however owing to the distortion of the waveform, the time during which current does not actually flows differs. Such non-application time during which current does not actually flows is called duration $t_k$ of complete pause as mentioned above.

According to the present invention, hydrogen is dispersed in the duration of current interruption $t_0$ and suppressed from being incorporated in plated film, and the crystal face of a deposited metal can be controlled by controlling the reduced atom weight per pulse, thereby allowing for plating without cracking. The foregoing control of the reduced atom weight per pulse can be carried out by controlling the current density and the frequency.

According to the present invention, electroplating is carried out by pulsed electrolysis wherein hydrogen emitted from the cathode interface is dispersed far from the interface to lower the probability of absorbing hydrogen in crystal particles of chromium as well as to give arrangement of preferential orientation in high energy face, to prevent cracking, and to improve the wear resistance, ductility, and hardness of a plated film. In the case of chromium plating, which is of a body-centered cubic lattice, the crystal face is oriented in the (111) face where the atomic density is highest and the orientation ratio can be made to be 95% or higher by using the plating conditions as claimed in the present invention.

The numeral definitions of the present invention will be described below.

As described later, the relation between the quantity of deposited lattice per pulse and existence of cracks was studied using the pulse frequency as a parameter, and it was found that no cracking occurred (refer to table 1) in the condition that the ratio of the quantity of deposited lattice is 0.28 or lower (700 Hz or higher). Therefore, the ratio of the quantity of deposited lattice is 0.28 or lower (700 Hz or higher).

Meanwhile, the relation between the ratio of the quantity of deposited lattice and the pulse frequency is approximately same at current density used commonly for metal plating in a range of 10 to 1,200 A/dm$^2$ if the current density is set up uniformly. When the ratio of the quantity of deposited lattice is 0.28, the frequency is 700 Hz and when the ratio of the quantity of deposited lattice is 0.22, the frequency is 900 Hz. Further, as described later, the surface roughness or the like of the plated film is stabilized and improved by controlling the frequency to be 900 Hz or higher, so it is preferable to control the ratio of the quantity of deposited lattice to 0.22 or lower.

If the duty ratio is controlled to be 0.5, cracking is stably suppressed, so that the duty ratio is set to be 0.5 or lower. The smaller the duty ratio is, the longer becomes the ratio of pause duration of the current application. Further, at the same current density, though the ratio of pause duration of the current application per pulse becomes shorter as the frequency increases, the quantity of electrolysis per pulse is lowered as well. In this case, there is no lower limit of the duty ratio. However, as the foregoing duty ratio is lowered, the pause duration of the current application becomes longer and that is effective for dispersion of emitted hydrogen and on the other hand, it takes a long plating time accordingly.

Also, the higher the current density is, the easier the pulse waveforms are distorted and the time (the duration of complete pause) during which practically no current flows becomes shorter than the pause duration (the duration of current interruption) of the current with ideal waveform. Taking that in consideration, the relation between the duration of current interruption and the duration of complete pause is studied and in the present invention, the duration of complete pause is regulated to at shortest one half of the duration of current interruption, because cracking occurred when the duration of complete pause is not more than one half of the duration of current interruption.

Next, the pulse frequency can be controlled to be about 900 Hz or higher.

According to the present invention, by controlling the pulse frequency to 900 Hz or higher, as noted above, the crystal particle diameter becomes small stably and the surface roughness is improved (refer to FIG. 5 and FIG. 7).

The method can be carried out by pulse plating while fluidizing a plating solution to be brought into contact with an object body to be plated at a flow velocity of about 0.04 (m/s) or higher.

By fluidizing the plating solution, dispersion of emitted hydrogen is promoted and hydrogen is more suppressed from being incorporated in the plated film.

The relation between the flow velocity of a plating solution and the crystal particle diameter of a plated film was studied and it was found that the crystal of the plated film is stably made fine and the orientation ratio of the foregoing high energy face is heightened by controlling the flow velocity to be 0.04 (m/s) or higher (refer to FIG. 3 and FIG. 4) and, therefore, the flow velocity is regulated to be 0.04 (m/s) or higher. Though the upper limit of the flow velocity is not specifically limited, it is preferable, in relation to the composition and the viscosity of the plating solution and the flow path of the plating solution in a plating bath, to keep the flow velocity sufficient to the extent within which no turbulent current such as swirling current is generated in the periphery of the object body in the fluidized plating solution.

The pulse frequency can be controlled to be about 900 Hz or higher and the following formula is satisfied when the ratio of the quantity of deposited lattice per pulse to the height of the lattice is Y and the pulse frequency is X (Hz).

$$Y \leqq -0.0932 \times ln(X) + 0.8376$$

By specifying such a range, the corrosion resistance under high temperature is improved (refer to FIG. 15).

BRIEF DESCRIPTION OF THE DRAWINGS

FIG. 2 illustrates pulse waveform:

FIG. 2(*a*) shows the ideal pulse waveforms and

FIG. 2(*b*) shows one example of pulse waveform in distorted state;

FIG. 3 shows the relation between the flow velocity and the crystal particle diameter;

FIG. 8(*a*) shows the surface state and

FIG. 8(*b*) shows pulse waveforms;

FIG. 9(*a*) shows the surface state and FIG. 9(*b*) shows pulse waveforms;

FIG. 10(*a*) shows the surface state and FIG. 10(*b*) shows pulse waveforms;

FIG. 11(*a*) shows the surface state and FIG. 11(*b*) shows pulse waveforms;

DETAILED DESCRIPTION OF THE PREFERRED EMBODIMENTS

Preferred embodiments of the present invention will be described below with reference to the drawings.

Figure 1:
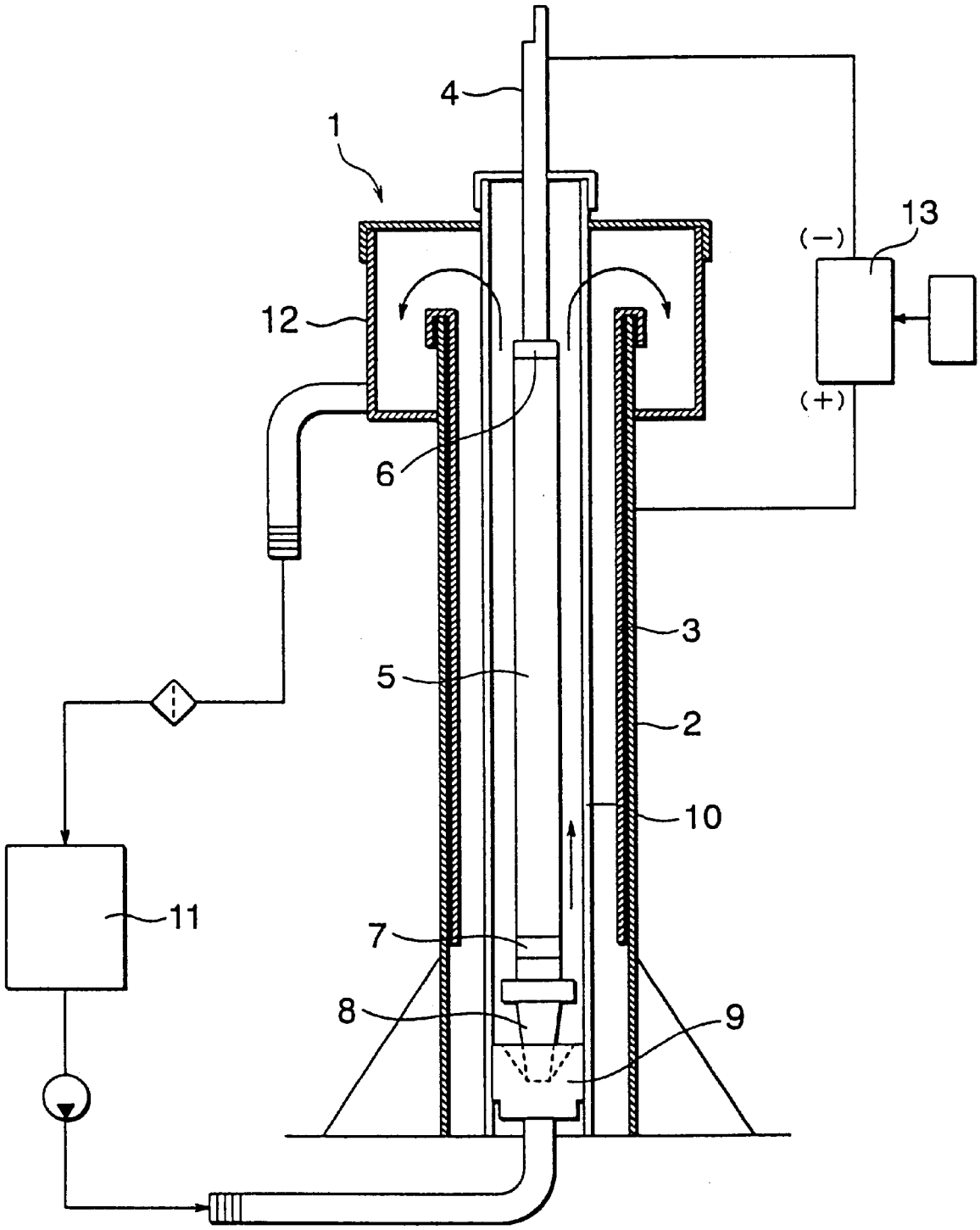
FIG. 1 is schematic view illustrating a plating apparatus relevant to preferred embodiments of the present invention.

FIG. 1 is a block diagram illustrating a plating apparatus according to a preferred embodiment.

This embodiment will be described while exemplifying chromium plating for metal plating.

Reference numeral 1 denotes a plating electrolytic tank and comprises a cylindrical plating tank main body 2 whose axis is set up and down and a cylindrical anode plate 3 coaxially installed in the plating tank main body 2 along the inner face. An object body 5 to be plated which is communicated with a cathode rod 4 is disposed in the center of the foregoing plating tank main body 2. In this embodiment, the face to be plated, an outer face of the object body 5, has a cylindrical shape.

In FIG. 1, reference numerals 6 and 7 denote collars, reference numeral 8 denotes a center pole, and reference numeral 9 denotes a center guide stand. A shield cylinder 10 is disposed between the object body 5 and the anode plate 3 to prevent the object body 5 from interfering with the anode plate 3 at the time of inserting or plating the object body 5.

The lower end face of the plating tank main body 2 is so connected to a plating solution tank 11 through a pump as to pneumatically send the plating solution to the plating tank main body 2 from the plating solution tank 11.

Also, the upper end face of the foregoing plating tank main body 2 is communicated with an overflow tank 12 and the plating solution flowing to the overflow tank 12 flows in the foregoing plating solution tank 11 and thus the plating solution is circulated. In FIG. 1, the arrow shows the flowing direction of the plating solution.

In the plating electrolytic tank 1 with the above described structure, the plating solution flows upward from the lower side and flows parallel to the surface of the object body 5 and evenly in the whole circumference in the circumferential direction.

Further, the foregoing cathode rod 4 and the anode plate 3 are so connected to a pulse oscillator 13 as to periodically supply pulsed current between both of them 4 and 3.

In this case, a conventionally employed plating solution is used as the foregoing plating solution. For example, the plating solution is prepared from a mixture of solutions of chromic acid, sulfuric acid and additives and the bath temperature in the plating tank main body 2 is controlled to be about 75° C.

The object body 5 to be inserted in the foregoing plating tank main body 2 is, as same in a conventional method, is previously subjected to pretreatment such as surface-polishing and alkaline degreasing and the like.

While the plating solution of the plating solution tank 11 being sent at a flow rate of 0.04 (m/s) or higher to the plating tank main body 2, chromium plating with 15 $\mu$m thickness is carried out by pulsed electrolysis by setting the pulse plating conditions of 0.5 duty ratio, 1,500 Hz frequency, and 50 A/dm$^2$ current density. The plating duration is about 30 minutes.

By carrying out chromium plating in such a plating apparatus described above, a chromium plating coating free from cracks can be formed on the object body 5 without requiring previous nickel plating.

Moreover, since taking in of hydrogen in the plated film can be suppressed and no cracking occurs and the crystal density is heightened, the thickness of the plating coating can be set to be thick and the luster of the obtained plating coating is excellent.

Since the foregoing plating electrolytic tank 1 can circulate the plating solution along the surface of the object body 5 at even flow rate in the whole circumference in the circumferential direction, evolved hydrogen can evenly be dispersed over the whole plated surface area of the object body 5 to result in improvement of the luster, the surface roughness, and ductility in the whole plated surface area.

In the above described embodiment, electroplating is carried out while fluidizing the plating solution, however electroplating may be carried out without fluidizing the plating solution. Nevertheless, the crystal of the deposited chromium layer can be made dense and fine by carrying out plating while fluidizing the plating solution at the above described flow velocity, 0.04 (m/s).

In this embodiment, the pulse frequency is controlled to be 1500 Hz, it is not limited to this. By controlling the pulse frequency to be 900 Hz or higher and so that the ratio of the quantity of deposited lattice is 0.28 or lower, the crystal particle diameter becomes small stably and the surface roughness is improved. That is, the precise and homogeneous plated film is formed and the luster is increased.

Next, the second embodiment of the present invention will be described below. The basic composition of this embodiment is the same as that of the above noted first embodiment.

However, the second embodiment differs from the first embodiment at the point that the pulse frequency is controlled to be 900 Hz or higher and the current density is controlled so as to be satisfied the following formula according to the pulse frequency when the ratio of the quantity of deposited lattice is Y and the pulse frequency is X (Hz).

$$Y \leq -0.0932 \times ln(X) + 0.8376$$

The ratio of the quantity of deposited lattice can be changed by changing the pulse frequency or the current density. However, since the ratio of the quantity of deposited lattice is changed by the bath temperature, the pulse frequency and the current density may be set up so that the ratio of the quantity of deposited lattice becomes within the range of the present invention in consideration of the amount of the change by the change of the bath temperature.

The crack does not occur on the plated film of this embodiment even if the object body with which the plated film is given is used in the environment under high temperature (160° C.). That is, the corrosion resistance of the plated film is improved.

The other advantages are the same as that of the first embodiment.

EXAMPLES

First Example

The Quantity of Deposited Lattice Per Pulse

The following were calculated and observed: existence of cracks in a plated film at the time of depositing chromium in 20 $\mu$m thickness on an object body 5 using the frequency as a parameter by an electroplating apparatus with the above described structure and the quantity of deposited lattice per pulse at that time. In this case, the current density was set to be 175 A/dm$^2$ and the plating solution is not fluidized.

The results are shown in Table 1.

TABLE 1

| Frequency | Deposition quantity (Å) per pulse | The ratio of quantity of deposited lattice per pulse | Existence of cracks 175 A/dm$^2$ |
|---|---|---|---|
| 4,950 | 0.0614 | 0.0369 | ○ (non) |
| 2,100 | 0.1559 | 0.0937 | ○ (non) |
| 1,500 | 0.2183 | 0.1313 | ○ (non) |
| 1,000 | 0.3274 | 0.1969 | ○ (non) |
| 900 | 0.3638 | 0.2188 | ○ (non) |
| 800 | 0.4093 | 0.2461 | ○ (non) |
| 750 | 0.4366 | 0.2625 | ○ (non) |
| 700 | 0.4677 | 0.2812 | ○ (non) |
| 500 | 0.6548 | 0.3937 | x (exist) |
| 330 | 0.9922 | 0.5966 | x (exist) |

As being understood from Table 1, chromium plating with no cracks and as thick as 20 $\mu$m thickness can be realized without requiring nickel plating as an undercoating by setting a frequency of 700 Hz or higher, that means the ratio of the quantity of deposited lattice to the lattice height to be 0.28 or lower.

Additionally, it was confirmed that the same results as shown in Table 1 could be obtained even if the current density was 50 A/dm$^2$.

Second Example

Flow Velocity

The crystal particle diameter of a chromium layer deposited in the following electroplating conditions was calculated using the flow rate of the fluidized plating solution as a parameter and Table 2 shows the results.

Plating Conditions

| | |
|---|---|
| Frequency: | 1,500 Hz |
| Current density: | 250 A/dm$^2$ |
| Bath temperature in the plating tank main body 2: | 75° C. |
| Current application quantity: | 280 A × minute |
| Cathode: | abrasive S45C |
| Anode: | lead |

Measurement Conditions of the Particle Diameter

Calculated based on the following Sherrer's equation by x-ray diffraction: $D=\kappa\times\lambda/\beta\times\cos\theta$, wherein D: crystal particle diameter λ: x-ray wavelength employed for measurement=1.5405 (CuKα)

β: half width (radian)

θ: Bragg angle of the diffracted rays

κ: Sherrer's constant=0.94

TABLE 2

| Flow velocity (m/s) | Crystal particle diameter (nm) | Half width (rad) | Bragg angle (°) | 2θ | Half width (°) |
|---|---|---|---|---|---|
| 0.013 | 12.830 | 0.0297 | 67.640 | 135.280 | 1.705 |
| 0.027 | 11.244 | 0.0338 | 67.590 | 135.180 | 1.941 |
| 0.044 | 7.751 | 0.0489 | 67.520 | 135.040 | 2.803 |
| 0.067 | 7.840 | 0.0486 | 67.620 | 135.240 | 2.789 |
| 0.095 | 7.980 | 0.0480 | 67.730 | 135.460 | 2.755 |

1° ≈ 0.01745 rad

From the results of Table 2, the relation between the flow velocity and the crystal particle diameter is studied and shown in FIG. 3. As being understood from FIG. 3, the crystal particle diameter can be made stably small by controlling the flow rate to be 0.04 (m/s) or higher.

Figure 4:
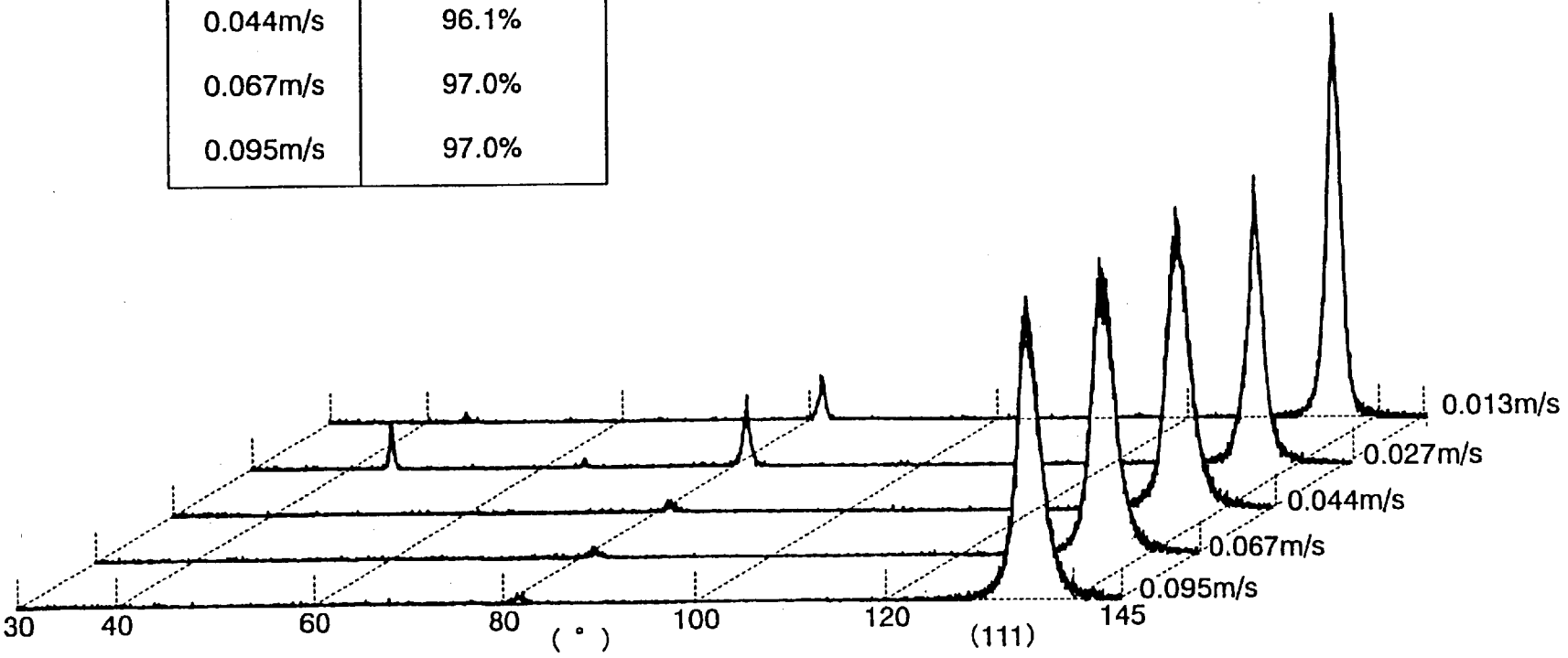
FIG. 4 shows the relation between the flow velocity and the face orientation ratio.

Further, the f ace orientation ratio was studied to obtain results shown in FIG. 4. As being understood from FIG. 4, the (111) face orientation ratio can be kept 96% or higher and the chromium layer is made dense by setting the flow velocity to be 0.04 (m/s) or higher. In consideration of a view of densifying the density, it is preferable to control the flow velocity to be 0.067 (m/s) or higher.

Third Example

The crystal particle diameter of a chromium layer deposited in the following electroplating conditions was calculated using the frequency as a parameter and the obtained results are shown in Table 3.

TABLE 3

| Frequency (Hz) | Crystal particle diameter (nm) | Half width (rad) | Bragg angle (°) | 2θ | Half width (°) |
|---|---|---|---|---|---|
| 330 | 17.136 | 0.010 | 32.300 | 64.60 | 0.605 |
| 500 | 17.336 | 0.009 | 22.210 | 44.42 | 0.518 |
| 700 | 13.610 | 0.028 | 67.620 | 135.24 | 1.591 |
| 800 | 12.260 | 0.031 | 67.580 | 135.16 | 1.776 |
| 900 | 9.250 | 0.041 | 67.540 | 135.08 | 2.370 |
| 1,000 | 8.490 | 0.045 | 67.700 | 135.40 | 2.600 |
| 1,630 | 8.110 | 0.047 | 67.650 | 135.30 | 2.711 |

TABLE 3-continued

| Frequency (Hz) | Crystal particle diameter (nm) | Half width (rad) | Bragg angle (°) | 2θ | Half width (°) |
|---|---|---|---|---|---|
| 3,000 | 7.637 | 0.050 | 67.710 | 135.42 | 2.897 |
| 5,000 | 7.716 | 0.049 | 67.720 | 135.44 | 2.838 |

1° ≈ 0.01745 rad

Plating Conditions

| | |
|---|---|
| Frequency: | 330–5000 Hz |
| Current density: | 175 A/dm$^2$ |
| Bath temperature in the plating tank main body 2: | 75° C. |
| Current application quantity: | 520 A × minute |
| Cathode: | abrasive S45C |
| Anode: | platinum with air aeration and without fluidizing the plating solution |

Measurement Conditions of the Particle Diameter

Calculated based on the following Sherrer's equation by x-ray diffraction: $D=\kappa\times\lambda/\beta\times\cos\theta$, wherein D: crystal particle diameter λ: x-ray wavelength employed for measurement=1.5405 (CuKα)

β: half width (radian)

θ: Bragg angle of the diffracted rays

κ: Sherrer's constant=0.94

Figure 5:
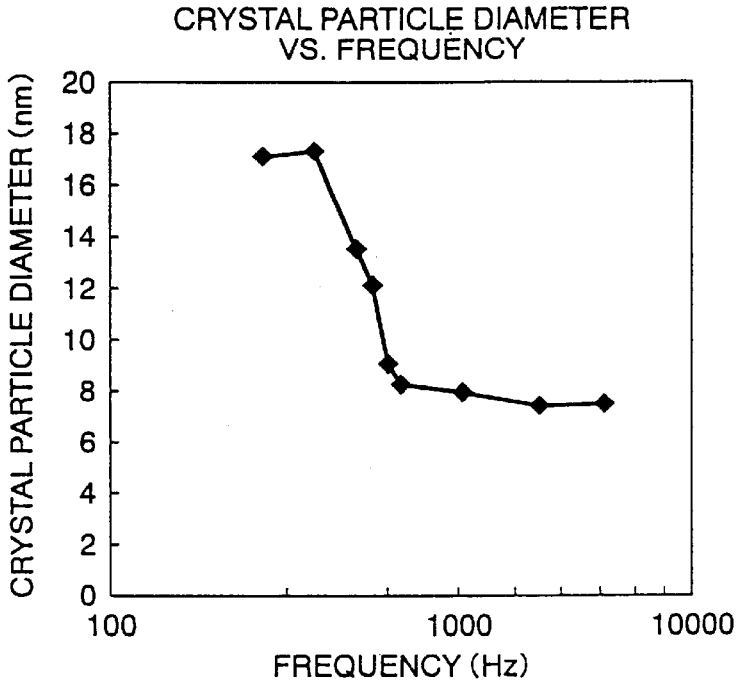
FIG. 5 shows the relation between the frequency and the crystal particle diameter.

From the results of Table 3, the relation between the frequency and the crystal particle diameter is studied and shown in FIG. 5.

As being understood from Table 3 and FIG. 5, the crystal particle diameter of the deposited chromium layer can be made 12.3 (nm) or smaller by controlling the frequency to be 700 Hz or higher. Especially, by controlling the frequency to be 900 Hz or higher, the crystal particle diameter can stably be made about 10 (nm) or smaller.

Further, the surface roughness was studied to obtain results shown in Table 4.

TABLE 4

| Frequency (Hz) | Surface roughness (Ra) | Surface roughness (Rz) |
|---|---|---|
| 700 | 0.047 | 0.269 |
| 800 | 0.039 | 0.241 |
| 900 | 0.017 | 0.080 |
| 1,000 | 0.019 | 0.084 |
| 1,630 | 0.020 | 0.089 |

The numeral values are average values.

Measurement was carried out using SE3500 made by Kosaka Laboratory and the measurement conditions were as following:

| | |
|---|---|
| Cut off | 0.25 mm |
| Measurement length | 1.25 mm |
| N | 5 |

Figure 6:
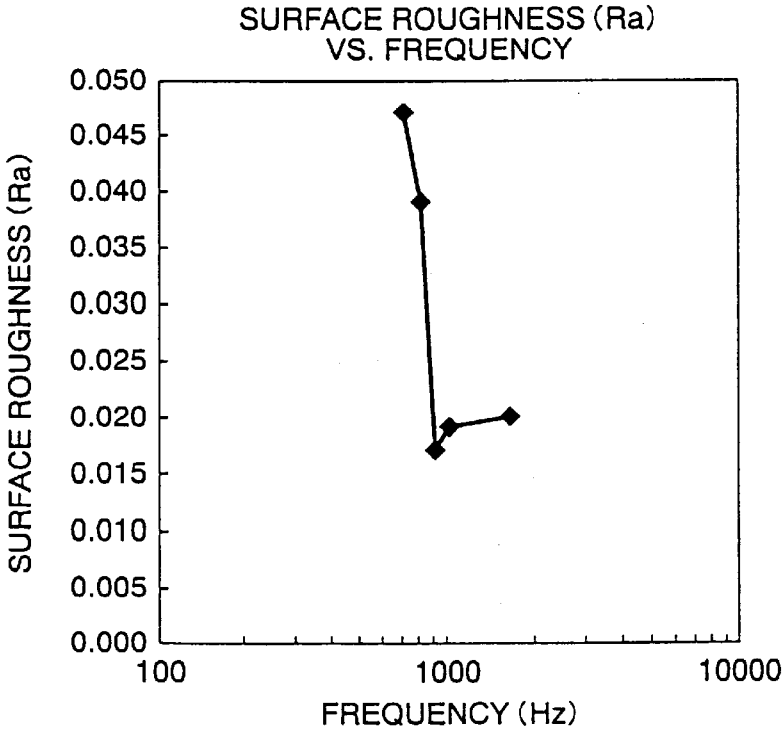
FIG. 6 shows the relation between the frequency and the surface roughness.
Figure 7:
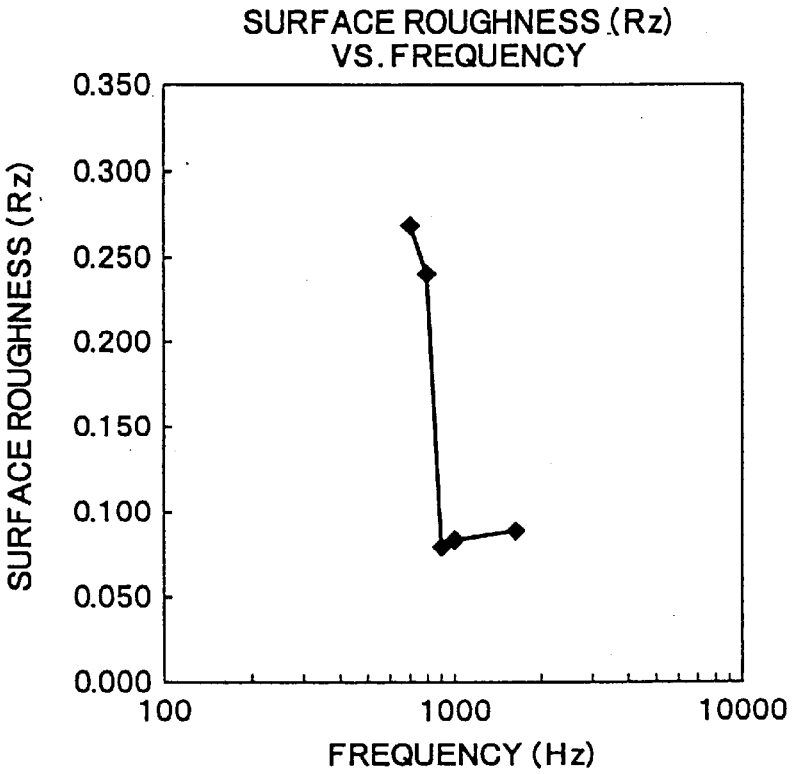
FIG. 7 shows the relation between the frequency and the surface roughness.
Figure 8:
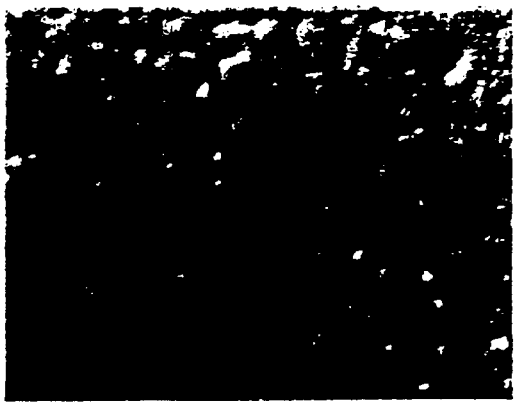
FIG. 8 shows the state at 1,000 Hz frequency.
Figure 8:
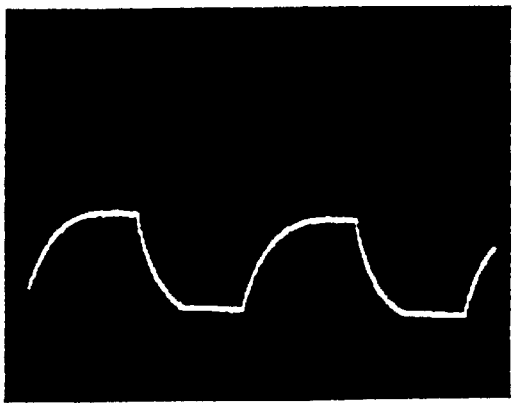
Figure 9:
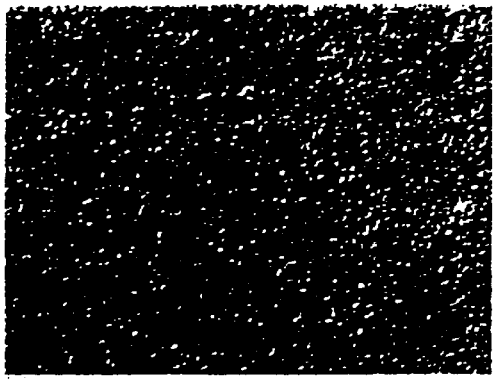
FIG. 9 shows the state at 900 Hz frequency.
Figure 9:
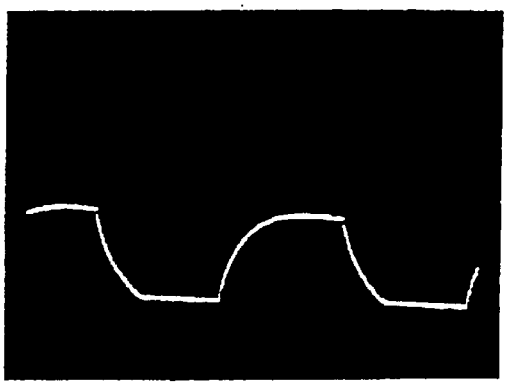
Figure 10:
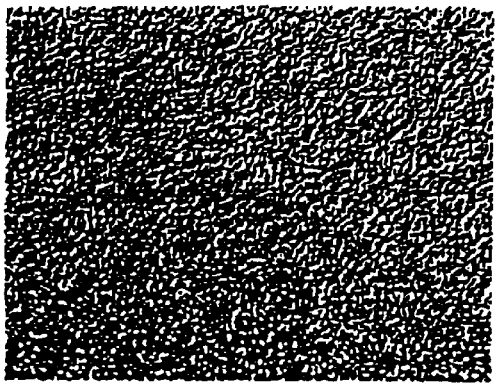
FIG. 10 shows the state at 800 Hz frequency.
Figure 10:
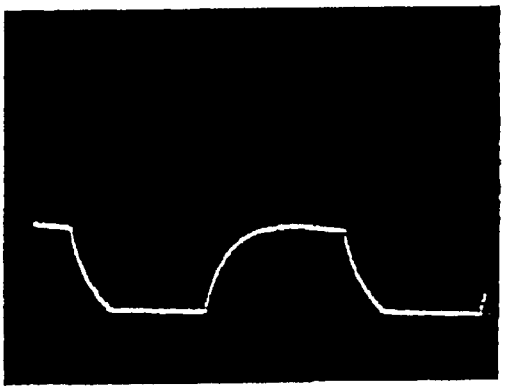
Figure 11:
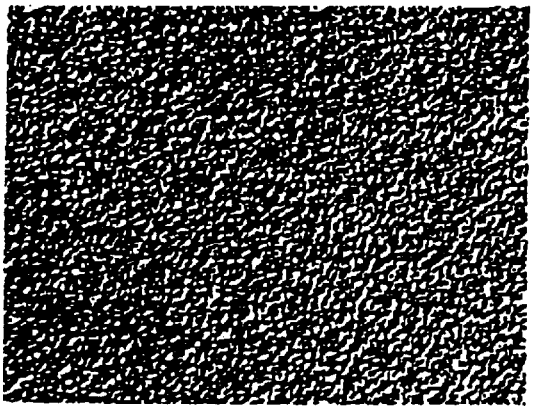
FIG. 11 shows the state at 700 Hz frequency.
Figure 11:
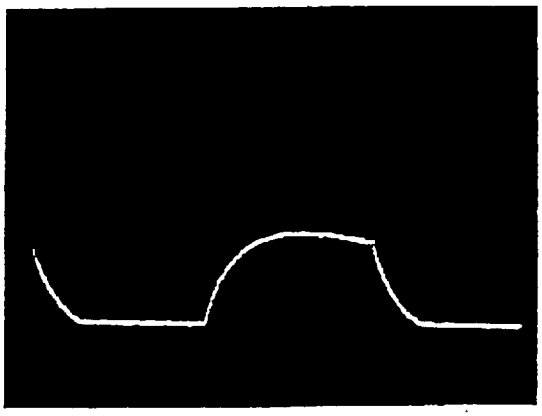

The relations of the surface roughness and the frequency based on FIG. 4 are illustrated in FIG. 6 and FIG. 7.

As being understood from FIG. 6 and FIG. 7, the surface roughness is found drastically improved by controlling the frequency to be 900 Hz or higher even without carrying out nickel plating as an undercoating.

The state of the surfaces of the chromium layers deposited at the respective frequency values and the pulse waveforms in these cases are shown in FIG. 8 to FIG. 11. Also, from these figures, the luster of the surfaces is found more improved as the frequency is heightened more.

Figure 12:
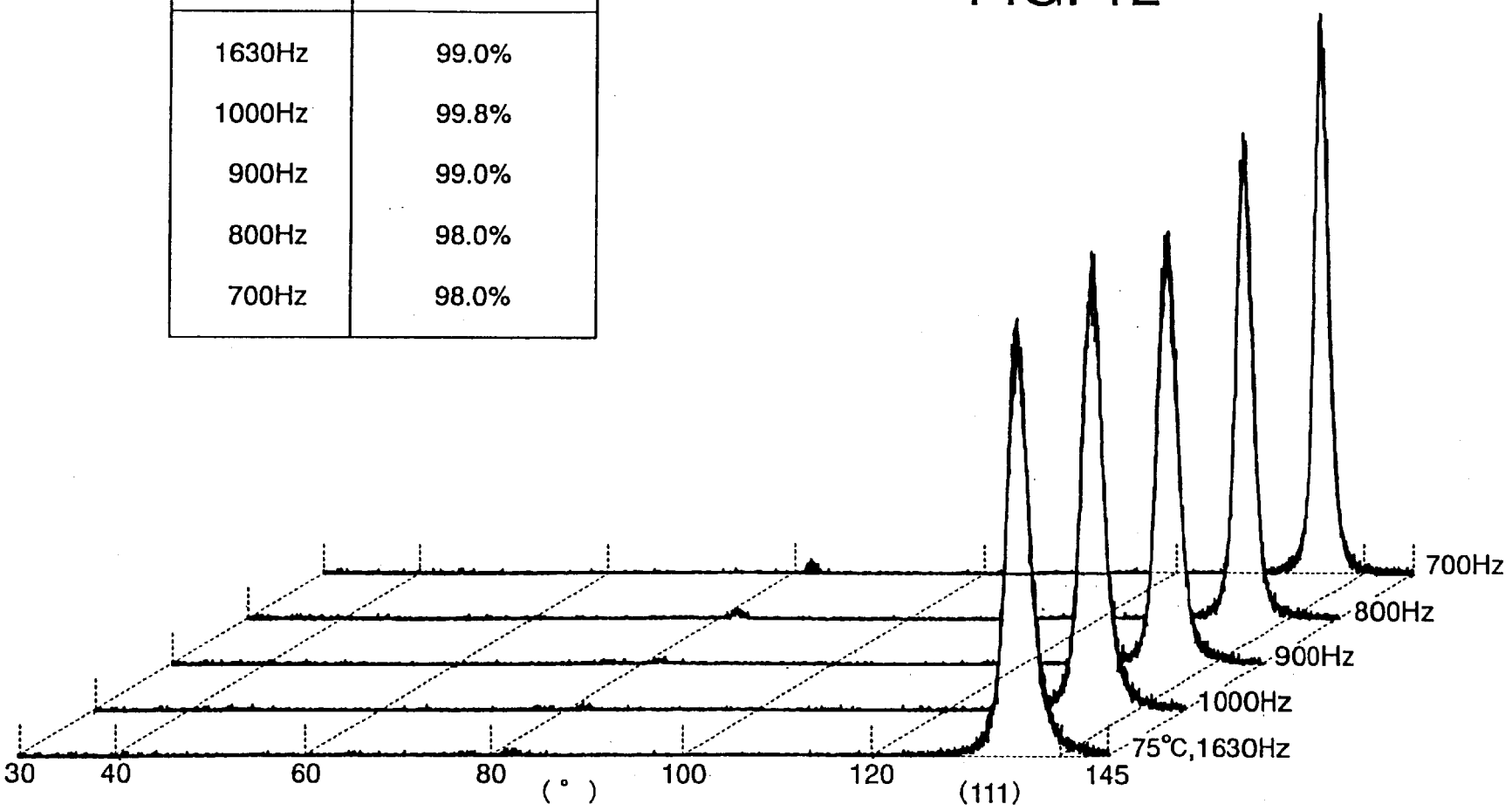
FIG. 12 shows the relation between the frequency and the face orientation ratio.

Moreover, the (111) face orientation ratio was studied to obtain results shown in FIG. 12. As being understood from FIG. 12, the (111) face orientation can be kept 98% or higher by controlling the frequency to be 700 Hz or higher, namely, the quantity of deposited lattice per pulse to be at most 0.28 times as much as the height of the lattice.

Furthermore, the relation between the frequency and the coating hardness was studied to obtain results shown in Table 5.

TABLE 5

| Frequency (Hz) | Coating hardness (Hk) | Coating hardness (Hv) |
|---|---|---|
| 700 | 401 | 479 |
| 800 | 596 | 567 |
| 900 | 860 | 825 |
| 1000 | 959 | 805 |
| 1630 | 1000 | 927 |

The hardness numeral values are average values.

The measurement was carried out employing an MVK-H3 type ultra small hardness testing apparatus made by Akashi Co. at 245 mN measurement load of specimen N=5.

Figure 13:
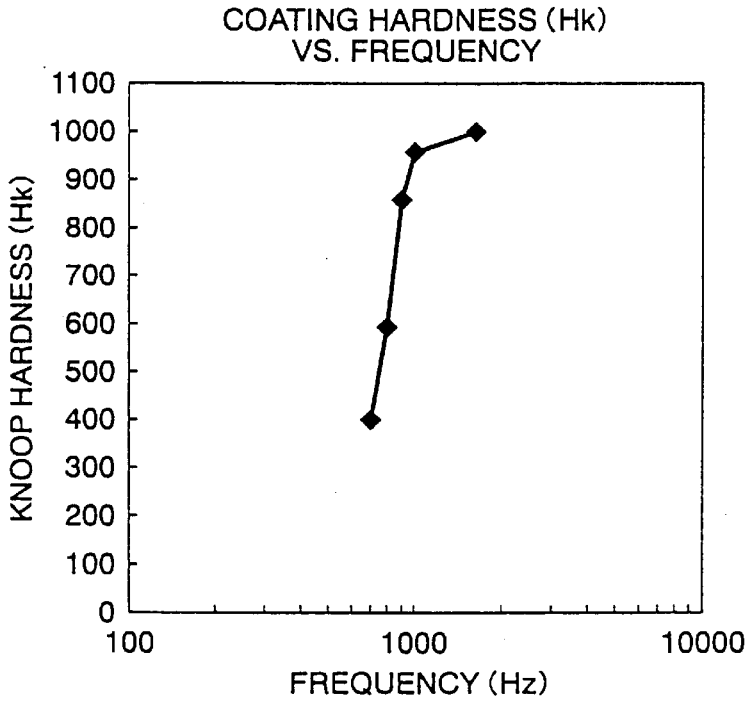
FIG. 13 shows the relation between the frequency and the Knoop hardness.
Figure 14:
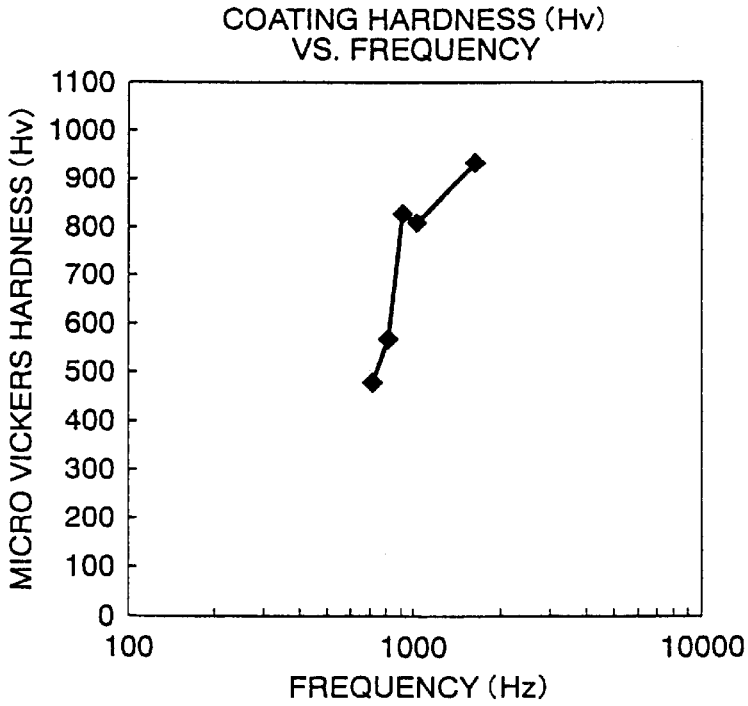
FIG. 14 shows the relation between the frequency and the micro Vickers hardness.

FIG. 13 and FIG. 14 represent the results shown Table 5 in graphical form.

Generally 800 (Hv) or higher hardness is required and it can be found that sufficiently high hardness to satisfy the requirement is reliably provided, even without carrying out nickel plating as an undercoating, by controlling the frequency to be 900 Hz or higher.

As described above, the present invention provides a method of an effective metal plating to give excellent corrosion resistant metal coating.

Next, the fourth examples will be described below.

The chromium was deposited on an object body 5 under the following plating conditions by using an electroplating apparatus with the structure as shown in FIG. 1 in order to confirm the advantage of the above noted second embodiment. At this time, a plurality of samples (object bodies) by which the ratio of the quantity of deposited lattice is changed by changing a setup of the current density in each pulse frequency was created, as shown in Tables 6A and 6B.

After the above noted plating process end, the object body was held in the state where it heated at 160° C. for one hour, and then, natural cooling was carried out. Then, the existence of the crack occurring was investigated about the plated film of the object body 5 (henceforth, it is called a heat resistance evaluation examination).

The ratio of the quantity of deposited lattice is changed also by the bath temperature.

Figure 15:
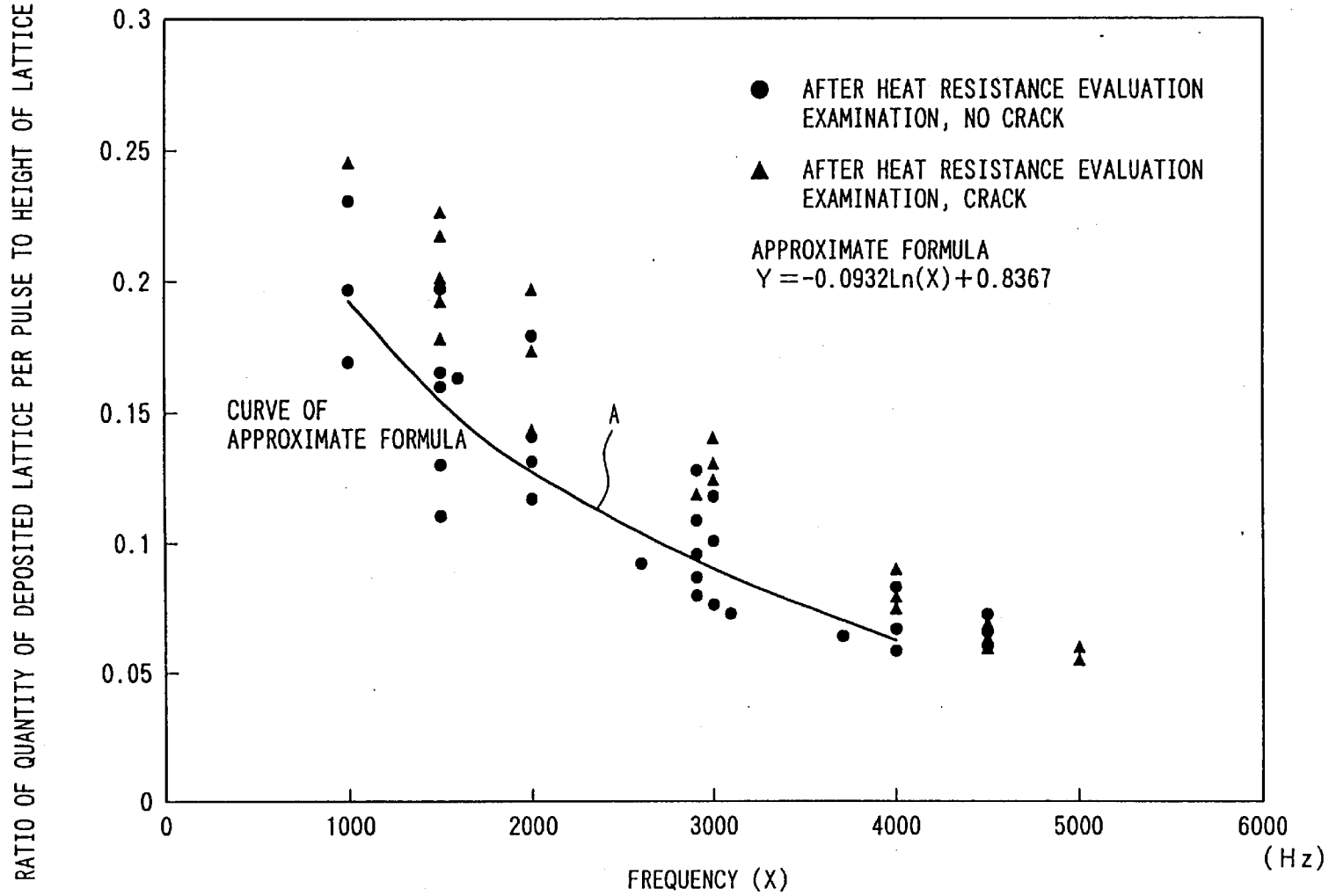
FIG. 15 shows the relation between the quantity of deposited lattice per pulse, the frequency and the heat resistance in the fourth example.

The results are shown in Tables 6A and 6B and FIG. 15.

Plating Conditions

| | |
|---|---|
| Frequency: | 1000–5000 Hz |
| Current density: | 130–300 A/dm$^2$ |
| Bath temperature in the plating tank main body 2: | 75~78° C. |
| Current application quantity: | 2230 A × minute |
| Cathode: | abrasive S45C |
| Anode: | lead |
| Fluidity of the plating solutiom: | 0.07 m/s |

TABLE 6A

| Frequency (Hz) | Quantity of Deposited lattice per Pulse (Å) | Ratio of Quantity of Deposited lattice per Pulse | Existence of Crack (Before Heat Resistance Evaluation) | Existence of Crack (After Heat Resistance Evaluation) |
|---|---|---|---|---|
| 1000 | 0.2835 | 0.170 | NON | NON |
| 1000 | 0.3271 | 0.197 | NON | NON |
| 1000 | 0.3850 | 0.232 | NON | NON |
| 1000 | 0.4087 | 0.246 | NON | EXIST |
| 1500 | 0.1851 | 0.111 | NON | NON |
| 1500 | 0.2174 | 0.131 | NON | NON |
| 1500 | 0.2583 | 0.155 | NON | NON |
| 1500 | 0.2673 | 0.161 | NON | NON |
| 1500 | 0.2771 | 0.167 | NON | NON |
| 1500 | 0.2977 | 0.179 | NON | EXIST |
| 1500 | 0.3210 | 0.193 | NON | EXIST |
| 1500 | 0.3326 | 0.200 | NON | EXIST |
| 1500 | 0.3359 | 0.202 | NON | EXIST |
| 1500 | 0.3626 | 0.218 | NON | EXIST |
| 1500 | 0.3775 | 0.227 | NON | EXIST |
| 1600 | 0.2727 | 0.164 | NON | NON |
| 2000 | 0.1963 | 0.118 | NON | NON |
| 2000 | 0.2195 | 0.132 | NON | NON |
| 2000 | 0.2362 | 0.142 | NON | NON |
| 2000 | 0.2400 | 0.144 | NON | EXIST |
| 2000 | 0.2910 | 0.175 | NON | EXIST |
| 2000 | 0.3002 | 0.180 | NON | NON |
| 2000 | 0.3293 | 0.198 | NON | EXIST |
| 2600 | 0.1547 | 0.093 | NON | NON |
| 2900 | 0.1347 | 0.081 | NON | NON |
| 2900 | 0.1464 | 0.088 | NON | NON |
| 2900 | 0.1613 | 0.097 | NON | NON |
| 2900 | 0.1829 | 0.110 | NON | NON |
| 2900 | 0.1996 | 0.120 | NON | EXIST |
| 2900 | 0.2145 | 0.129 | NON | NON |
| 3000 | 0.1280 | 0.077 | NON | NON |
| 3000 | 0.1696 | 0.102 | NON | NON |
| 3000 | 0.1987 | 0.120 | NON | NON |
| 3000 | 0.2093 | 0.126 | NON | EXIST |
| 3000 | 0.2199 | 0.132 | NON | EXIST |
| 3000 | 0.2356 | 0.142 | NON | EXIST |

TABLE 6B

| Frequency (Hz) | Quantity of Deposited lattice per Pulse (Å) | Ratio of Quantity of Deposited lattice per Pulse | Existence of Crack (Before Heat Resistance Evaluation) | Existence of Crack (After Heat Resistance Evaluation) |
|---|---|---|---|---|
| 3100 | 0.1231 | 0.074 | NON | NON |
| 3700 | 0.1098 | 0.066 | NON | NON |
| 4000 | 0.1010 | 0.061 | NON | NON |
| 4000 | 0.1145 | 0.069 | NON | NON |
| 4000 | 0.1281 | 0.077 | NON | EXIST |
| 4000 | 0.1356 | 0.082 | NON | EXIST |
| 4000 | 0.1414 | 0.085 | NON | NON |

TABLE 6B-continued

| Frequency (Hz) | Quantity of Deposited lattice per Pulse (Å) | Ratio of Quantity of Deposited lattice per Pulse | Existence of Crack (Before Heat Resistance Evaluation) | Existence of Crack (After Heat Resistance Evaluation) |
|---|---|---|---|---|
| 4000 | 0.1531 | 0.092 | NON | EXIST |
| 4500 | 0.1031 | 0.062 | NON | EXIST |
| 4500 | 0.1048 | 0.063 | NON | EXIST |
| 4500 | 0.1048 | 0.063 | NON | NON |
| 4500 | 0.1098 | 0.066 | NON | EXIST |
| 4500 | 0.1131 | 0.068 | NON | NON |
| 4500 | 0.1148 | 0.069 | NON | NON |
| 4500 | 0.1164 | 0.070 | NON | NON |
| 4500 | 0.1197 | 0.072 | NON | EXIST |
| 4500 | 0.1247 | 0.075 | NON | NON |
| 5000 | 0.0965 | 0.058 | NON | EXIST |
| 5000 | 0.1048 | 0.063 | NON | EXIST |

As understood from FIG. 15, in an area which the ratio of the quantity of deposited lattice is less than 0.28 and it is located more nearly up than a predetermined boundary line A, although there was no occurring of the crack in the plated film of the object body 5 immediately after plating, some samples which the crack has occurred in the plated film after the heat resistance evaluation examination has been confirmed.

On the other hand, in an area below the above noted boundary line A, there was no occurring of the crack in the plated film of the object body 5 immediately after plating and the occurring of the crack was not confirmed in the plated film after the heat resistance evaluation examination. That is, it is understood that the corrosion resistance under high temperature environment is high.

Further, if the ratio of the quantity of deposited lattice is Y and the pulse frequency is X (Hz) about the above noted boundary line A, $$Y=-0.0932\times ln(X)+0.8376$$

can be resembled.

Thus, when the plated film is formed, even if the object body after plating is used under 160° C. high temperature environment, maintaining high corrosion resistance can be continued, suppressing occurring the crack to the plated film.

As described above, the present invention provides a method of an effective metal plating to give excellent corrosion resistant metal coating even if it does not necessarily perform undercoating.

Further, the crystal particle diameter becomes small stably and the surface roughness is improved so that the plated film becomes precisely and uniform and the luster is increased.

Furthermore, the crystal particle diameter becomes small stably and the surface roughness is improved so that the plated film becomes precisely and uniform and the luster is increased. Especially, this effect becomes more significant when the pulse frequency is controlled to be about 900 Hz or higher.

Further, the corrosion resistance under high temperature is improved.

What is claimed is:

1. A chromium plating method for carrying out pulse plating by pulsed electrolysis by periodically applying electricity, wherein said pulsed electrolysis is carried out in condition that the pulse frequency and the current density are controlled so that the ratio of the quantity of deposited lattice per pulse to the height of the lattice is about 0.28 or lower, that the duty ratio of said pulse frequency is controlled to be about 0.5 or lower, and that the duration of complete pause caused by distortion of pulse waveforms is controlled to be one half or longer of the duration of current interruption.

2. The chromium plating method as set forth in claim 1, wherein said pulse frequency is controlled to be about 900 Hz or higher.

3. The chromium plating method as set forth in claim 1 or 2, wherein said pulse plating is carried out in condition that the plating solution to be brought into contact with an object body to be plated is fluidized at a flow velocity of about 0.04 m/s or higher.

4. The chromium plating method as set forth in claim 3, wherein said pulse frequency is controlled to be about 900 Hz or higher and the following formula is satisfied when the ratio of the quantity of deposited lattice per pulse to the height of the lattice is Y and the pulse frequency is X (Hz):

$$Y\leqq -0.0932\times ln(X)+0.8376.$$

5. The chromium plating method as set forth in claim 1, wherein said pulse plating is carried out in condition that the plating solution to be brought into contact with an object body to be plated is fluidized along a surface of the object body at a flow velocity of about 0.04 m/s or higher and sufficient to the extent within which no turbulent current is generated in the periphery of the object body.

6. A chromium plating method for carrying out pulse plating by pulsed electrolysis by periodically applying electricity, wherein said pulsed electrolysis is carried out in condition that the pulse frequency and the current density are controlled so that the ratio of the quantity of deposited lattice per pulse to the height of the lattice is about 0.28 or lower, that the duty ratio of said pulse frequency is controlled to be about 0.5 or lower, and that the duration of complete pause caused by distortion of pulse waveforms is controlled to be one half or longer of the duration of current interruption;

wherein said pulse plating is carried out in condition that the plating solution to be brought into contact with an object body to be plated is fluidized at a flow rate of about 0.04 m/s or higher;

wherein said pulse frequency is controlled to be about 900 Hz or higher and the following formula is satisfied when the ratio of the quantity of deposited lattice per pulse to the height of the lattice is Y and the pulse frequency is X (Hz):

$$Y\leqq -0.0932\times ln(X)+0.8376.$$

7. The chromium plating method as set forth in claim 6, wherein said pulse frequency is controlled to be about 900 Hz or higher.

* * * * *